US009228453B2

(12) United States Patent
Schneider et al.

(10) Patent No.: US 9,228,453 B2
(45) Date of Patent: Jan. 5, 2016

(54) CAMSHAFT

(75) Inventors: Falk Schneider, Korntal-Münchingen (DE); Thomas Flender, Eberdingen (DE); Stefan Steichele, Gerlingen (DE)

(73) Assignee: Mahle International GmbH (DE)

( * ) Notice: Subject to any disclaimer, the term of this patent is extended or adjusted under 35 U.S.C. 154(b) by 453 days.

(21) Appl. No.: 13/164,391

(22) Filed: Jun. 20, 2011

(65) Prior Publication Data

US 2011/0315100 A1 Dec. 29, 2011

(30) Foreign Application Priority Data

Jun. 23, 2010 (DE) ..... 10 2010 024 722

(51) Int. Cl.
*F01L 1/02* (2006.01)
*F01L 1/047* (2006.01)

(52) U.S. Cl.
CPC ..... *F01L 1/047* (2013.01); *F01L 2001/0475* (2013.01); *F01L 2001/0476* (2013.01)

(58) Field of Classification Search
CPC ..... F01L 1/047; F01L 2001/0475; F01L 2001/0476
USPC ..... 123/90.31, 90.6, 90.16
See application file for complete search history.

(56) References Cited

U.S. PATENT DOCUMENTS

| | | | | | |
|---|---|---|---|---|---|
| 4,787,345 | A | * | 11/1988 | Thoma | 123/90.17 |
| 5,377,638 | A | * | 1/1995 | Mueller | 123/90.17 |
| 5,738,052 | A | * | 4/1998 | Meurer et al. | 123/90.6 |
| 6,591,713 | B2 | * | 7/2003 | Jesel | 74/567 |
| 7,832,369 | B2 | * | 11/2010 | Schafer et al. | 123/90.17 |
| 2008/0170816 | A1 | | 7/2008 | Ueno et al. | |

FOREIGN PATENT DOCUMENTS

| | | | |
|---|---|---|---|
| DE | 19807675 | A1 | 8/1999 |
| DE | 102004043935 | A1 | 3/2006 |
| JP | 2000-314304 | A | 11/2000 |
| JP | 2006-226183 | A | 8/2006 |
| JP | 2006226400 | A | 8/2006 |
| JP | 04-012102 | B2 | 11/2007 |

OTHER PUBLICATIONS

English abstract for DE-19807675, Aug. 26, 1999.
English abstract for DE-105004043935, Mar. 30, 2006.
English abstract for JP-2000314304, Nov. 14, 2000.

* cited by examiner

*Primary Examiner* — Ching Chang
(74) *Attorney, Agent, or Firm* — Fishman Stewart Yamaguchi PLLC

(57) ABSTRACT

A camshaft of a combustion engine may include a drive element and first and second roller bearings for mounting the camshaft in the combustion engine. The drive element and at least the first roller bearing may be adjacent and exchangeable with one another.

14 Claims, 1 Drawing Sheet

CAMSHAFT

CROSS-REFERENCES TO RELATED APPLICATION

This application claims priority to German patent application DE 20 2010 024 722.7 filed on Jun. 23, 2010, which is hereby incorporated by reference in its entirety.

TECHNICAL FIELD

The present invention relates to a camshaft of a combustion engine with a drive element and several roller bearings for mounting the camshaft in the combustion engine. The invention further relates to a combustion engine with a camshaft which is mounted in such a way.

BACKGROUND

Camshafts are usually mounted in combustion engines of motor vehicles by means of roller bearings, because such roller bearings make possible a reduction of the bearing friction and hence a reduced fuel consumption. The individual roller bearings of the camshaft are, however, differently stressed here, wherein the greatest stress usually occurs on a drive element, in particular on a driving toothed wheel. Especially in utility vehicles, high bearing stresses occur in the region of the drive element, which in certain circumstances lead to a premature wear and hence to a high maintenance expenditure, based on the fact that usually the entire camshaft has to be dismantled, in order to replace the individual roller bearings.

SUMMARY

The present invention is therefore concerned with the problem of indicating an improved embodiment for a camshaft, which is distinguished in particular by a reduced maintenance expenditure.

This problem is solved according to the invention by the subject matter of the independent claim 1. Advantageous embodiments are the subject matter of the dependent claims.

The present invention is based on the general idea of constructing at least one drive element of a camshaft, for example a driving toothed wheel, and the first roller bearing adjacent hereto so as to be simply exchangeable, whereby the possibility is provided for simply replacing the maximally stressed roller bearing in the region of the camshaft and thereby reducing a maintenance expenditure which occurs. The roller bearing can be removed here for example by loosening a central screw connection and dismantling the drive element simply from the camshaft, without the latter having to be completely removed from an engine. Owing to the simple exchangeability of the at least first roller bearing adjacent to the drive element which is able to be achieved thereby, it is also conceivable that this is dimensioned smaller compared with the other roller bearings at which usually smaller stresses occur, and in particular is designed for a smaller number of operating hours, whereby the component price for such a roller bearing can be reduced. As the roller bearing adjacent to the drive element shows signs of wear first, owing to the highest stress, an exchangeable construction thereof is particularly advantageous, because with a wear of this roller bearing the entire camshaft does not now have to be removed or exchanged. Easily exchangeable in the sense of claim 1 means here that the roller bearing can be removed with minimal effort and by simple tools easily from the camshaft or respectively from a plug which closes the camshaft on the longitudinal end side, in particular without the entire camshaft having to be removed for this or an increased manual or mechanical effort having to be made.

In an advantageous further development of the solution according to the invention, the camshaft is closed on the longitudinal end side by a plug which carries the drive element and the greatest external diameter of which is smaller than the external diameter of the camshaft, so that at least the first roller bearing can be easily removed via the plug. In this case, the plug, which is for example screwed or respectively pressed together with the camshaft, therefore carries the drive element, which is preferably likewise connected with the plug via an easily detachable connection. For the exchange of the first roller bearing adjacent to the drive element, therefore only the drive element has to be dismantled from the plug, whereupon the adjacent roller bearing can then be simply removed from the camshaft via the plug. Owing to the smaller external diameter of the plug with respect to the shaft, even a non-contact removal of the roller bearing via the plug is conceivable. Of course, it is alternatively also conceivable that the drive element is connected non-detachably securely with the plug, wherein in this case the plug itself is connected so as to be easily detachable with the camshaft, so that the roller bearing can be simply dismantled from the camshaft, in so far as the plug is removed, and together with the latter, the drive element.

Expediently, the camshaft is closed on the longitudinal end side by a plug which carries both the drive element and also at least the first roller bearing. Here, generally, two different cases are conceivable: Firstly, the drive element can be connected detachably securely with the plug, but the plug itself can be connected detachably securely with the camshaft, so that on an exchange of the roller bearing only the plug together with the drive element and the roller bearing have to be dismantled from the camshaft, whereupon then either the entire unit, consisting of plug, drive element and roller bearing is replaced, or else a new roller bearing is mounted onto the plug. Another construction variant consists in that the plug is pressed together with the camshaft, i.e. is connected therewith so as to be not, or only difficultly detachable, whereas the drive element is connected with the plug so as to be easily detachable, so that after a removal thereof, the roller bearing, which is also arranged on the plug, can be removed. All the alternatives here have in common the fact that an exchange of the roller bearing which is the highest stressed and hence the most liable to wear is able to be brought about comparatively simply, whereby a high expenditure with regard to maintenance and repair can be avoided. The term "roller bearing" can of course include all possible embodiments, such as for example, grooved ball bearings, inclined ball bearings, four-point bearings, separable ball bearings, self-aligning ball bearings, cylinder roller bearings, tapered roller bearings, spherical and self-aligning roller bearings, needle bearings and axial bearings, such as for example axial grooved ball bearings, axial cylinder roller bearings and axial self-aligning roller bearings.

Further important features and advantages of the invention will be apparent from the subclaims, from the drawings and from the associated description of the figures with the aid of the drawings.

It shall be understood that the features named above and which are to be further explained below are able to be used not only in the respectively indicated combination, but also in other combinations or alone, without departing from the scope of the present invention.

Preferred example embodiments of the invention are illustrated in the drawings and are explained in further detail in the following description, wherein identical reference numbers refer to identical or similar or functionally identical components.

BRIEF DESCRIPTION OF THE DRAWING

There are shown here, diagrammatically respectively

DETAILED DESCRIPTION

Figure 1:
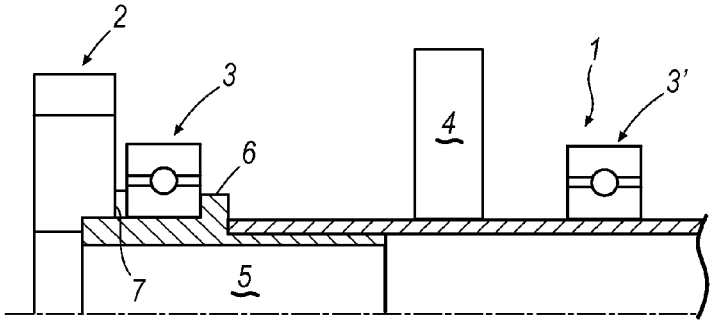
FIG. 1 a camshaft according to the invention, in a sectional representation, FIGS. 2 to 4 respectively a representation as in FIG. 1, but with different embodiments.

In accordance with FIG. 1, a camshaft 1 according to the invention has a drive element 2, usually a driving toothed wheel, and several roller bearings 3, 3' for mounting the camshaft 1 in a combustion engine, which is not shown. Of the roller bearings 3, 3', only two are shown, with it being of course clear that the camshaft 1 is mounted in the combustion engine via further roller bearings which are not shown. Furthermore, cams 4 are arranged on the camshaft 1, via which for example associated valves of the combustion engine are controlled. According to the invention, now at least the drive element 2 and at least the first roller bearing 3 adjacent to the drive element 2 are constructed so as to be easily exchangeable. Owing to its proximity to the drive element 2, the roller bearing 3 is the highest stressed roller bearing on the camshaft 1, so that it is exposed to a comparatively high degree of wear and usually is the first to fail. The further roller bearings, of which only the roller bearing 3' is shown, are subject to a distinctly lower stress. The easy exchangeability of the most highly stressed roller bearing 3 offers the great advantage that in the case of a repair or maintenance, the entire camshaft 1 no longer has to be dismantled from the combustion engine or respectively from a cylinder crankcase, but rather only the drive element 2 and subsequently the roller bearing 3 have to be removed and exchanged.

According to FIG. 1, the camshaft 1 is closed here on the longitudinal end side by a plug 5, which carries both the drive element 2 and also the roller bearing 3. The roller bearing 3 rests here at one end onto a stop 6 of the plug 5, wherein it is prestressed via the drive element 2 against this stop 6. A spacer element 7 can be additionally arranged here between the drive element 2 and the roller bearing 3.

Figure 3:
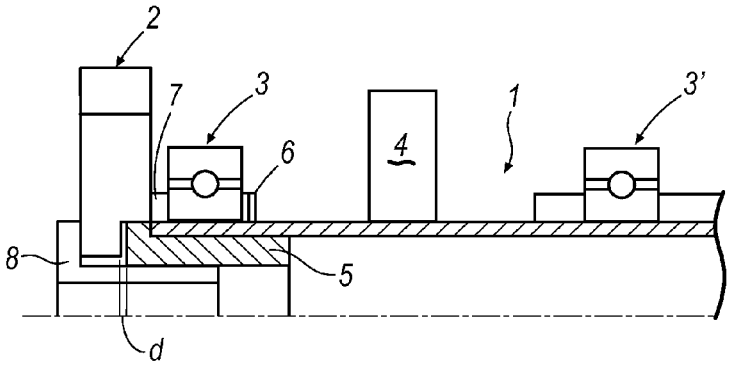

In the camshaft 1 according to FIG. 1, several variants cam be conceivable here. On the one hand for example, the entire plug 5 can be constructed so as to be easily removable from the camshaft 1, so that an exchange of the roller bearing 3 can take place simply by a dismantling of the plug 5, whereupon the latter together with the drive element 2 and the roller bearing 3 can be exchanged and a new unit of a camshaft 1 can be mounted. It is also conceivable that firstly the plug 5 is dismantled from the camshaft 1, then the drive element 2 is removed from the plug 5, in order to then remove the roller bearing 3, exchange it, and then mount the drive element 2 on the plug 5 and mount the plug 5 in the camshaft 1. The drive element 2 can be held here for example by means of a screw connection 8 (cf. FIG. 3) on the plug 5, or else can be pressed together thereon. Alternatively, it is also conceivable that the plug 5 remains on the camshaft 1 for the exchange of the roller bearing 3, so that in this case the drive element 2 is firstly dismantled from the plug 5 and subsequently the roller bearing 3 is replaced, whereupon the drive element 2 is mounted again.

Figure 2:
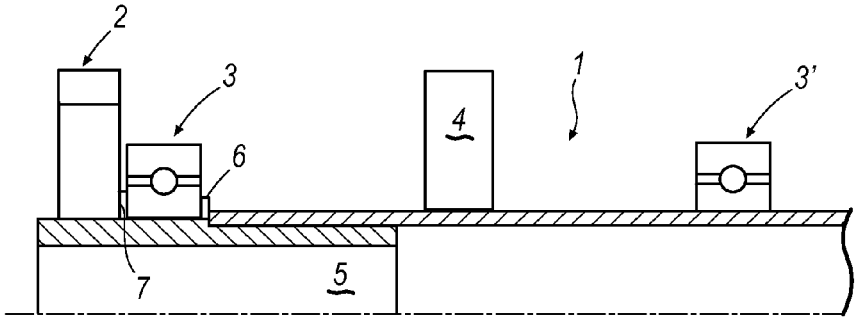

In the camshaft 1 according to FIG. 2, the plug 5 closes the camshaft 1 on the longitudinal end side and at the same time carries both the drive element 2 and also the first roller bearing 3. In this case, likewise an exchange of the roller bearing 3 can take place according to the alternative explained with respect to FIG. 1. In contrast to FIG. 1, the drive element 2 according to FIG. 2 is pressed together here in a frictionally engaged manner with the plug 5.

According to FIG. 3, a plug 5 is again shown, which closes the camshaft 1 on the longitudinal end side and in addition likewise carries the drive element 2. The greatest external diameter of the plug 5 is smaller here than the external diameter of the camshaft 1, so that at least the adjacent roller bearing 3 can be easily removed via the plug 5. The fixing of the drive element 2 can take place here for example again via the screw connection 8, wherein an at least small axial play d can exist between the plug 5 and the screw connection 8. The screw connection 8 generally stands for a fastening element here which is screwed into the plug 5, wherein of course it is also conceivable that no screw connection is selected here, but rather a frictionally engaged press connection.

In an advantageous further development of the solution according to the invention, the roller bearing 3 is mounted with approximately 15 μm play on the camshaft 1, whereby an exchange is once again facilitated. Generally, the roller bearing 3 can be constructed here as an open or closed bearing and can either receive only radial bearing forces or else both radial and axial bearing forces.

Figure 4:
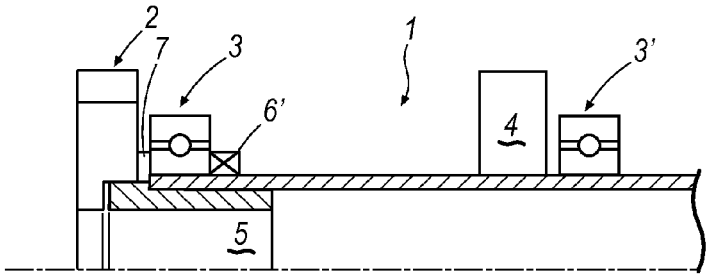

According to FIG. 4, the first roller bearing 3 is again arranged on the camshaft 1 and lies against an axial stop 6'. Between the roller bearing 3 and the drive element 2, a spacer element 7 is again arranged, which spaces apart the drive element 2, pressed in a frictionally engaged manner onto the plug 5, axially to an end face of the plug 5. In this case also the greatest external diameter of the plug 5 can be at least slightly smaller than the external diameter of the camshaft 1, whereby a removal of the roller bearing 3 from the camshaft 1 via the plug 5 is facilitated. In this case it is therefore conceivable that to exchange the roller bearing 3, firstly the drive element 2 is removed from the plug 5, or else the drive element 2 together with the plug 5 are removed from the camshaft 1. The roller bearing 3 can then be exchanged.

With the roller bearing 3 according to the invention and which is easily exchangeable, in particular an expenditure on maintenance and repair can be distinctly reduced, wherein furthermore it is conceivable that the roller bearing 3 is dimensioned smaller compared with the remaining roller bearings 3', in order to thus achieve an improved cost structure.

The invention claimed is:

1. A camshaft of a combustion engine comprising:

a drive element and first and second roller bearings for mounting the camshaft in the combustion engine, wherein the drive element and at least the first roller bearing are adjacent and exchangeable; and a plug mounted in the camshaft;

wherein the drive element is pressed together in a frictionally engaged manner with the plug;

wherein the first and second roller bearings are disposed external to the drive element;

wherein the drive element and the first roller bearing are carried directly on a common outer diameter of the plug.

2. The camshaft according to claim 1, wherein the camshaft is closed on a longitudinal end side by the plug, and the plug is carrying the drive element.

3. The camshaft according to claim 2, wherein the drive element is selectively detachably secured with the plug.

4. The camshaft according to claim 3, wherein the camshaft is closed on a longitudinal end side by the plug, and the plug is carrying the drive element and at least the first roller bearing.

5. The camshaft according to claim 3, wherein the first roller bearing is mounted with 15 μm radial play on at least one of the camshaft and the plug.

6. The camshaft according to claim 5, wherein the drive element is a toothed wheel.

7. The camshaft according to claim 1, wherein the camshaft is closed on a longitudinal end side by the plug, and the plug is carrying the drive element and at least the first roller bearing.

8. The camshaft according to claim 7, wherein the first roller bearing is mounted with 15 μm radial play on at least one of the camshaft and the plug.

9. The camshaft according to claim 1, wherein the drive element is a toothed wheel.

10. The camshaft according to claim 1, wherein the first roller bearing is constructed as at least one of an open bearing, a radial bearing and an axial bearing.

11. The camshaft according to claim 1, wherein the camshaft is closed by the plug on a longitudinal end side, the longitudinal end side carrying the drive element and the plug has an external diameter that is less than an outer diameter of the camshaft so that at least the first roller bearing can be removed via the plug.

12. The camshaft according to claim 1, wherein the first roller bearing is not disposed radially within the drive element.

13. The camshaft according to claim 1, wherein the drive element and the first roller bearing are spaced apart from one another along an longitudinal axis of the plug.

14. The camshaft according to claim 1, wherein the first and second roller bearings are spaced apart from one another along a longitudinal axis of the camshaft.

* * * * *

UNITED STATES PATENT AND TRADEMARK OFFICE

CERTIFICATE OF CORRECTION

PATENT NO. : 9,228,453 B2
APPLICATION NO. : 13/164391
DATED : January 5, 2016
INVENTOR(S) : Falk Schneider et al.

It is certified that error appears in the above-identified patent and that said Letters Patent is hereby corrected as shown below:

In the Claims:

At column 6, claim number 13, line number 15, delete “an” after “along” and insert --a--.

Signed and Sealed this
Sixteenth Day of August, 2016

Michelle K. Lee

Michelle K. Lee
*Director of the United States Patent and Trademark Office*